US005282758A

United States Patent [19]

Onoue

[11] Patent Number: 5,282,758

[45] Date of Patent: Feb. 1, 1994

[54] ELECTRICAL CONTACT

[75] Inventor: Nobuaki Onoue, Kanagawa, Japan

[73] Assignee: AMP Incorporated, Harrisburg, Pa.

[21] Appl. No.: 689,035

[22] Filed: May 31, 1991

[30] Foreign Application Priority Data

Nov. 11, 1988 [JP] Japan ..... 63-147282
Oct. 10, 1989 [WO] PCT Int'l Appl. ..... PCT/US89/04322

[51] Int. Cl.[5] ..... H01R 4/24
[52] U.S. Cl. ..... 439/395; 439/876
[58] Field of Search ..... 439/485, 493, 395, 83, 439/77, 396, 397, 399, 400–407, 876

[56] References Cited

U.S. PATENT DOCUMENTS 4,780,092 10/1988 Fruchard et al. ..... 439/395
4,840,578 6/1989 Sato ..... 439/395

FOREIGN PATENT DOCUMENTS 3781485 12/1981 Japan .
8601941 3/1986 PCT Int'l Appl. ..... 439/395

*Primary Examiner*—Larry I. Schwartz
*Assistant Examiner*—Hien D. Vu
*Attorney, Agent, or Firm*—Adrian J. LaRue; Timothy J. Aberle

[57] ABSTRACT

An electrical contact comprising a holding section (2) formed of opposing side plates (6) bent from a bottom plate (5), a contact section (3) extending outwardly from the holding section (2) for electrical connection with a circuit board, a wire-connection section (4) between the side plates (6) for electrical connection to an insulated electrical wire (30), projections (18) at the sides of the wire-connection section (4) disposed in projection-receiving holes (8) in the side plates (6), and the side plates (6) having thermal-insulation holes (9, 9') adjacent the projection-receiving holes (8) to dissipate heat conducted along the contact section (3) and holding section (2) when the contact section (3) is soldered to the circuit board to obviate the melting or softening of the insulation of the electrical wire (30) in the wire-connection section (4).

5 Claims, 2 Drawing Sheets

ELECTRICAL CONTACT

This invention relates to an electrical contact, more specifically to a contact for electrically connecting an electrical wire to a printed circuit board.

BACKGROUND OF THE INVENTION

In conventional technology to electrically connect an electrical wire to a printed circuit board, an electrical contact is used which is to be soldered after having a contact section inserted into a through-hole of such circuit board.

Such type of electrical contact is made of a metal plate by a stamping and forming technique and comprises a holding section for holding the contact in a dielectric housing, an insertion or contact section to be inserted in a through-hole in a circuit board, and a wire-connection section as part of the holding section.

As mentioned above, such electrical contact is normally soldered when the contact section is inserted in a through-hole in a circuit board. It is inherent that soldering heat is conducted to the wire-connection section, thereby softening or melting the insulation covering the electrical wire connected to the wire-connection section of the electrical contact. This may result in reducing the force to hold the stranded conductors of the electrical wire to such an extent that the conductors are unstably or improperly connected to the wire-connection section of the electrical contact. However, such conventional electrical contact has no effective means to overcome such problem.

It is, therefore, an object of this invention to provide an electrical contact having thermal-insulation holes for dissipating heat adjacent to the wire-connection section, thereby effectively solving the problem encountered in the conventional electrical contact.

SUMMARY OF THE INVENTION

In order to achieve the above problem, the present contact comprises a holding section formed by both side plates, an insertion or contact section formed by outwardly-extending legs of the holding section, and a wire-connection section located between the side plates. Projections are formed at both edges of the wire-connection section to be disposed in holes in the side plates.

The present invention features the electrical contact having thermal-insulation holes of desired size and shape adjacent to the projection-receiving holes for dissipating heat.

Such electrical contact is made from a metal strip through a series of stamping and forming steps to form various sections. In this case, the holding section is formed from a bottom plate by bending side plates from the bottom plate. Also, the wire-connection section may be made from a part of the bottom plate by a stamping and forming technique.

In any mode, the wire-connection section is preferably designed to have a slot for an insulation-displacement connection of an electrical wire therein. The present contact is particularly useful for such contact.

In a preferred embodiment of the present contact, the thermal-insulation holes are preferably in communication with the projection-receiving holes to dissipate heat conduction to the wire-connection section.

The electrical contact of the present invention as constructed above is soldered after inserting the contact section into a through-hole of a printed circuit board. The heat generated by the soldering operation is effectively dissipated when conducted through the contact section and the holding section to the wire-connection section by the thermal-insulation holes. Consequently, heat conduction to the electrical wire electrically connected in the insulation-displacement slot is effectively dissipated.

The electrical contact according to the present invention is described in detail hereunder by way of example with reference to the following description in conjunction with the accompanying drawings.

DESCRIPTION OF THE PREFERRED EMBODIMENT(s)

Figure 1:
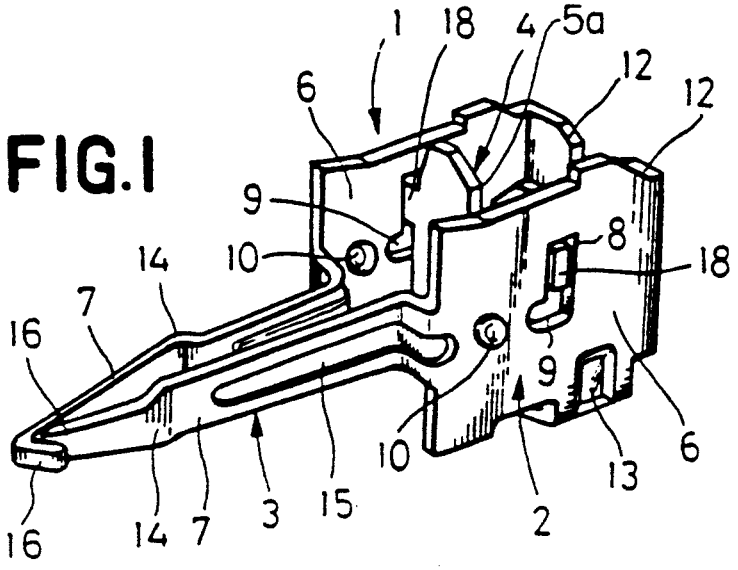
FIG. 1 is a perspective view of one embodiment of the electrical contact.
Figure 2:
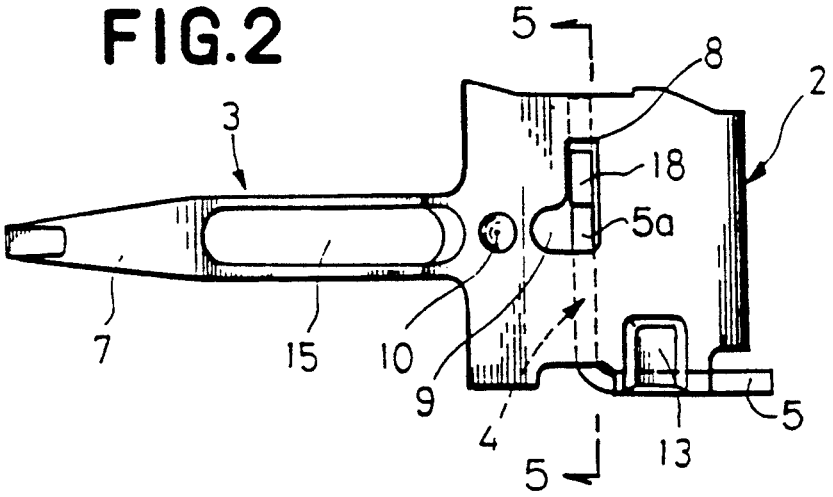
FIG. 2 is a side elevational view of the electrical contact in FIG. 1
Figure 3:
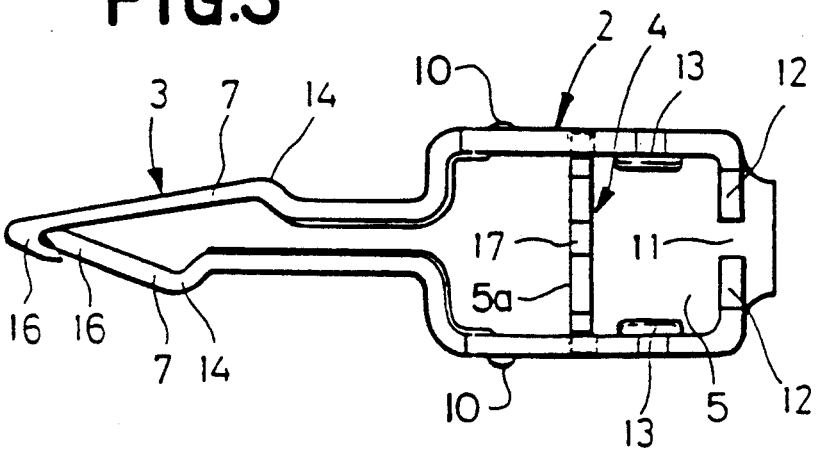
FIG. 3 is a top plan view of the electrical, contact in FIG. 1.
Figure 4:
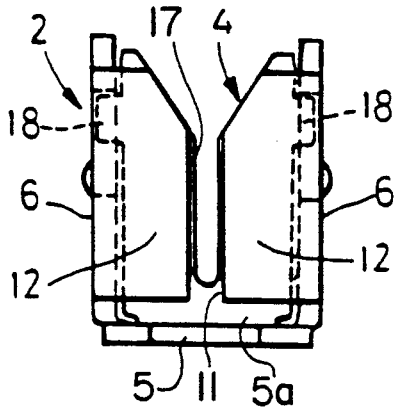
FIG. 4 is a rear elevational view of the electrical contact in FIG. 1.

As shown in FIGS. 1 through 6, a contact 1 is made of a metal plate by conventional stamping and forming practices. The contact 1 comprises a holding section 2 for holding the contact in a dielectric housing (see FIG. 7), an insertion or contact section 3 to be inserted into a through-hole in a printed circuit board, and a wire-connection section 4 located in the holding section 2. The holding section 2 is made of a bottom plate 5 bent to form opposed side plates 6 at both side edges thereof. The insertion or contact section 3 is made of a pair of resilient strips or legs 7 extending outwardly from the center portion of the side plates 6. The wire-connection section 4 is formed by upwardly bending a part 5*a* of the bottom plate 5 and is located between side plates 6. The holding section 2 comprises projection-receiving holes 8 at substantially a center portion of the side plates 6 and thermal-insulation holes 9 are in communication with the holes 8. Engaging projections 10 are formed on both outer surfaces of the side plates 6 adjacent to the base portions of the strips or legs 7 for engaging side surfaces of a housing cavity to hold the contact therein. A pair of wire-holding members 12 are bent inwardly from side plates 6 across bottom plate 5 leaving a gap 11 therebetween. Wire-pressing projections 13 extend inwardly in side plates 6 adjacent the bottom plate S.

The insertion or contact section 3 has staggered stepped portions 14 at substantially center portions of the strips or legs 7 and reenforcing projections 15 extending from the base portions toward the outer ends 19 of the strips 7. Also, an outer end 16 of one strip 7 is hooked over outer end 16 of the other strip 7. The wire-connection section 4 has a wire-connection slot 17 in part 5*a* at the center portion thereof and projections 18 at both side edges that are disposed in the projection-receiving holes 8.

Figure 6:
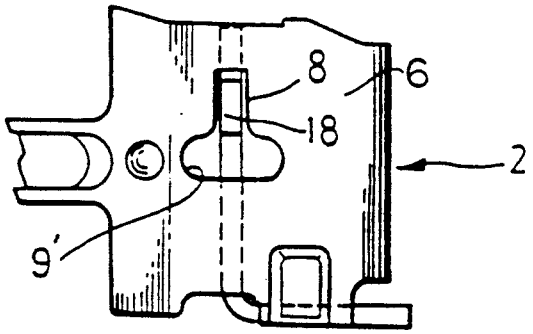
FIG. 6 is a part side view of another embodiment of the electrical contact showing a thermal-dissipating hole.

Shown in FIG. 6 is another embodiment of the thermal-insulation holes 9. The thermal-insulation holes 9' of the alternative embodiment extend in the longitudinal direction of the contact 1 and are symmetrical, thereby enhancing the thermal-dissipating efficiency.

Figure 7:
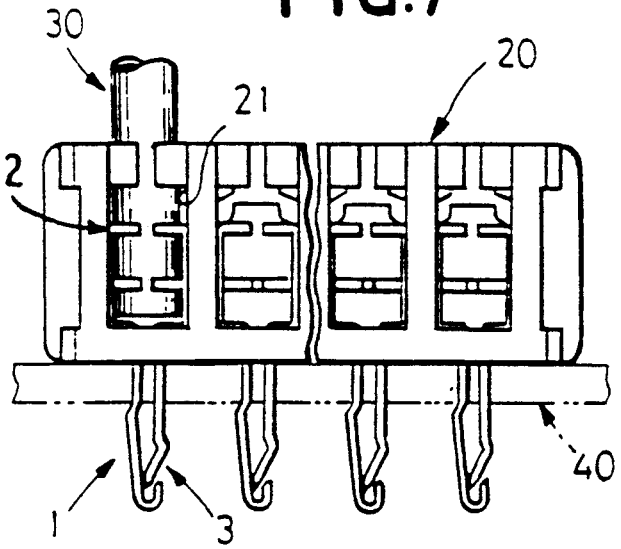
FIG. 7 is a top plan view of a dielectric housing in which the electrical contacts according to this invention are secured.
Figure 8:
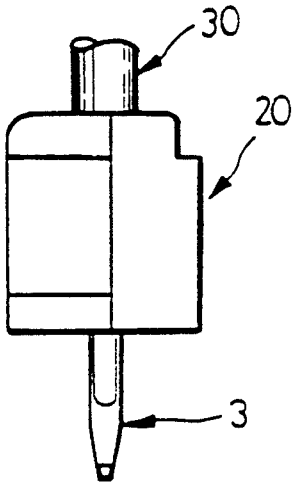
FIG. 8 is an end view of FIG. 7.

As shown in FIGS. 7 and 8, a plurality of contacts 1 are secured in cavities 21 in a housing 20 made of any suitable insulation material such as plastic. Each contact 1 is secured in a respective cavity 21 by inserting the holding section 2 therein so that at least the engaging projections 10 engage with the side surfaces of the cavity. In the secured condition, the insertion or contact section 3 extend outwardly from a bottom surface of the housing 20.

Figure 5:
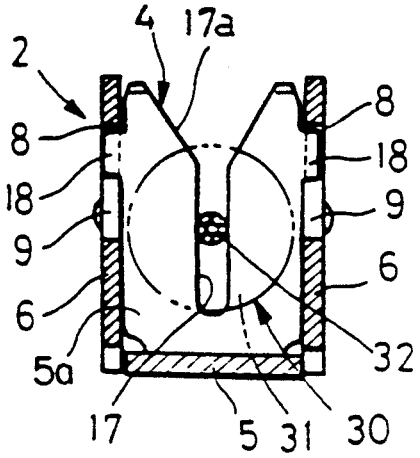
FIG. 5 is a cross-sectional view of the electrical contact along the line 5—5 in FIG. 2 to illustrate an electrical wire connected in the insulation-displacement slot along with the wire insulation being shown by phantom lines.

As shown in FIGS. 5, 7 and 8, an electrical wire 30 is electrically connected to each contact 1 of the aforementioned construction. More in detail, the wire 30 is pressed into the slot 17 of the wire-connection section 4 by way of tapered sections 17*a* at the upper portion for insulation displacement connection. That is, the inner edges of the slot 17 of the wire-connection section 4 penetrate the insulation 31 for electrically connecting the core conductors 32 to the slot edges 17 and the insulation 31 at a slight distance from the insulation displacement connected position of the electrical wire is held in the gap 11 between wire-holding members 12. The contact sections 3 of the electrical contacts 1 electrically connected to respective electrical wires 30 via sections 4 are inserted into through-holes (not shown) in a printed circuit board 40 as shown in FIG. 7 by phantom lines.

According to the electrical contact of the present invention, thermal-insulation holes in the side plates forming the holding section and the wire-connection section exhibit good thermal-dissipation characteristics when the contact is soldered, thereby preventing the insulation of the electrical wire connected to the wire-connection section from softening or melting causing loss of connection force of the stranded wire conductors. Consequently, the unstable or improper electrical connection problem of the conventional electrical contact is effectively solved.

This invention is particularly effective to simplify electrical connection is such an instance where the wire-connection section has an insulation-displacement connection slot for making electrical connection of an electrical wire in such slot.

The thermal-dissipating efficiency to the connected wire is significant when the thermal-insulation holes are formed in a continuous manner with the projection-receiving holes in the side plates of the holding section which receive the projections of the wire-connection section.

I claim:

1. An electrical contact comprising a holding section formed of opposing side plates bent from a bottom plate, a contact section extending outwardly from said holding section for electrical connection with a circuit board, a wire-connection section between said side plates for electrical connection to an insulated electrical wire and projections at the sides of said wire-connection section disposed in projection-receiving holes in said side plates, characterized in that said side plates have thermal-insulation holes adjacent said projection-receiving holes to dissipate heat conducted along the contact section and holding section when the contact section is soldered to the circuit board to obviate the melting or softening of the insulation of the electrical wire in the wire-connection section, wherein at least one of said thermal insulation holes has at least one edge that is continuous with an edge of at least one of said projection receiving holes.

2. An electrical contact as claimed in claimed 1, characterized in that the wire-connection section is a part of the bottom plate and has a slot.

3. An electrical contact as claimed in claim 1, characterized in that wire holding members are bent inwardly from said side plates across said bottom plate leaving a gap therebetween.

4. An electrical contact as claimed in claim 1, characterized in that said contact section includes resilient legs having staggered stepped portions.

5. An electrical contact comprising a holding section formed of opposing side plates bent from a bottom plate, a contact section extending outwardly from said holding section for electrical connection with a circuit board, a wire-connection section between said side plates for electrical connection to an insulated electrical wire and projections at the sides of said wire-connection section disposed in projection-receiving holes in said side plates, characterized in that at least one of said side plates has thermal insulation means interposed between said projections and said side plates for insulating said projections from heat conducted along the contact section and holding section when the contact section is soldered to the circuit board and thereby prevent the melting or softening of the insulation of the electrical wire in the wire-connection section, and wherein said thermal insulation means comprises an insulating gap formed by said at least one projection-receiving hole and a thermal-insulation hole, whereby thermal conductivity is impeded across said insulating gap.

* * * * *